US005929570A

United States Patent [19]

Shinohara et al.

[11] Patent Number: 5,929,570

[45] Date of Patent: Jul. 27, 1999

[54] MICRO-WAVE PLASMA DEVICE WITH A METAL COOLING WIRE WRAPPED AROUND THE INSULATING TUBE

[75] Inventors: Kibatsu Shinohara, Yokohama; Satoru Ishida, Machida; Hiroyuki Ueyama, Yokohama, all of Japan

[73] Assignees: Nihon Koshuha Kabushiki Kaisha, Kanagawa; Daihen Corporation, Osaka, both of Japan

[21] Appl. No.: 09/026,506

[22] Filed: Feb. 19, 1998

[51] Int. Cl.[6] ..... H05H 1/46

[52] U.S. Cl. ..... 315/111.21; 313/231.31

[58] Field of Search ..... 315/111.21; 118/723 MW, 118/723 ME; 156/345 MW; 313/231.31

[56] References Cited

U.S. PATENT DOCUMENTS 4,339,326 7/1982 Hirose et al. ..... 315/345 MW X 4,893,584 1/1990 Doehler et al. ..... 156/345 MW X 5,389,153 2/1995 Paranjpe et al. ..... 315/111.21 X 5,568,015 10/1996 Holber et al. ..... 315/111.21 X

*Primary Examiner*—Robert Pascal

*Assistant Examiner*—Justin P. Bettendorf

*Attorney, Agent, or Firm*—Finnegan, Henderson, Farabow, Garrett & Dunner. L.L.P.

[57] ABSTRACT

This invention is concerned with providing a micro-wave plasma generating device of a simple structure and with good cooling effect of the insulating tube. Micro-wave plasma generating device which generates the plasma by introduction of a processing gas into the insulating tube transversing through the micro-wave waveguide in which the metal wire or the metal rod is spirally wound on and around the insulating tube. An air-blowing means is further provided at a portion of the insulating tube through which the waveguide transverses. The metal wire wound around the insulating tube may be affixed to the tube using solder.

5 Claims, 1 Drawing Sheet

MICRO-WAVE PLASMA DEVICE WITH A METAL COOLING WIRE WRAPPED AROUND THE INSULATING TUBE

BACKGROUND OF THE INVENTION

1. Field of the Invention

This invention relates to a plasma generating device using micro-waves.

2. Description of Prior Arts

Micro-wave plasma has been used in the field of chemical vapor deposition (CVD) of semiconductor wafers, plasma usher, etching, and so forth. As has been well known, 'plasma' is meant by ionized gas containing ions, electrons, neutron particles, and being neutral as a whole. Depending on the purpose of its use, the micro-wave power, the gas flowrate, and the gas pressure are varied. In recent years, demands have become rapidly high in respect of increase in size and area of the semiconductor wafers. For coping with such demands, there has arisen a need for the plasma generating section to have a high withstanding voltage.

As the insulating tube for flowing the gas in the plasma generating section, use is made of quartz. Owing to its exhaustion and consumption by the plasma generation, this insulating tube is required to have easy exchangeability as a supply material. While this insulating tube poses no problem so far as the micro-wave power is low, if and when the power of 1 KW or higher is used, there is not a small possibility, wherein the insulating tube is broken due to generation of heat during its use. On account of this, cooling of the insulating tube takes an important role. For the method of cooling, there has so far been employed various expendients such that a water cooling pipe is spirally wound on and around the insulating tube or a water layer is provided thereon. As the result, the structure of the plasma generating device is liable to be complicated.

In view, therefore, of the abovementioned points of problems, it is the primary object of the present invention to provide a micro-wave generating device of a simple construction and with good cooling effect of the insulating tube.

With a view to attaining the abovementioned object, the present invention is directed to provide the micro-wave plasma generating device of a type which generates the plasma by introduction of a processing gas into the insulating tube which transverses through a micro-wave waveguide, and is characterized in that metal wire or metal rod is spirally wound on and around the insulating tube.

The foregoing object, other objects as well as the detailed construction and function of the micro-wave plasma generating device according to the present invention will become more apparent and understandable from the following detailed description of the invention, when read in conjunction with the accompanying drawing.

BRIEF DESCRIPTION OF THE ACCOMPANYING DRAWING

In the accompanying drawing, a single FIG. 1 is a front view showing one mode of embodiment of the micro-wave plasma generating device according to the present invention.

DETAILED DESCRIPTION OF THE INVENTION

Figure 1:
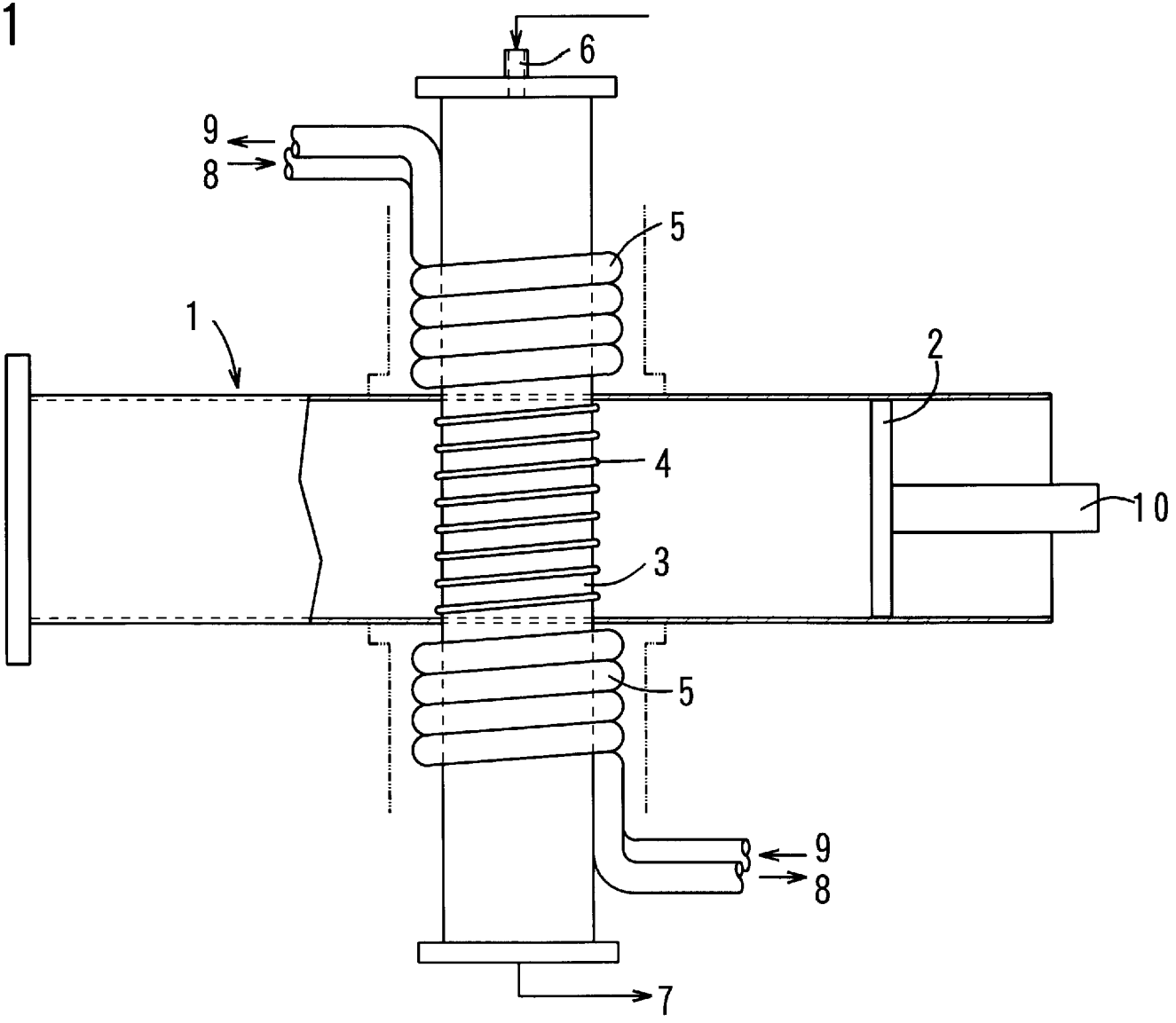

The abovementioned metal wire or metal rod to be spirally wound on and around the insulating tube may be wound over the entire insulating tube, or only on the portion thereof where the waveguide transverses through (i.e., the portion where the microwave is irradiated in the interior of the waveguide). In other construction, a coil of a water cooling pipe made of metal is wound on and around the portion other than that where the waveguide transverses through, so that a group of the metal wires or metal rods in a spiral form may constitute an intermediate member. Still other construction may be such one wherein the metal wire or the metal rod is spirally wound on and around the portion of the insulating tube within the waveguide, and the cooling pipe made of metal is wound on and around the other portion thereof.

The micro-wave plasma generating device according to the present invention may further be provided with an air-blowing means for cooling the abovementioned insulating tube, with the metal wire or the metal rod being wound on and around it, by blowing air from outside of the waveguide. With such air-blowing means, the cooling effect of the insulating tube can be much more improved. The metal wire or the metal rod may additionally be soldered onto the insulating tube. Also, the portion of the insulating tube other than the micrio-wave irradiating part thereof may be metallized. These expedients are all favorable means for attaining more effective cooling of the insulating tube for the purpose of the present invention.

The function of the present invention is to attain a higher cooling effect of the insulating tube in a micro-wave plasma generating device, and also is to further increase the cooling effect by blowing air from outside of the insulating tube, by utilizing the phenomenon such that the heat generated in the insulating tube is quickly dissipated to the external atmosphere through the metal wire or the metal rod of good heat conductivity, as wound on and around the outer periphery of the insulating tube for generating the plasma.

PREFERRED EMBODIMENT

In the following, a preferred embodiment of the micro-wave plasma generating device according to the present invention will be explained in detail in reference to the accompanying drawing. In the drawing, the single FIG. 1 is a front view showing one mode of embodiment of the micro-wave plasma generating device according to the present inveniton.

In FIG. 1, a reference numeral 1 designates a rectangular waveguide in a flat, angled cylindrical shape, to transmit the micro-wave electric power, and a numeral 3 refers to the insulating tube for generating the plasma, which transverses orthogonally through the rectangulatr wavelength 1. The insulating tube 3 has on its upper section an inlet port 6 for the processing gas, and on its lower section an outlet port 7 for the plasma generated at the lower section. A cooling water pipe 5 is spirally wound on and around the portion of the insulating tube 3 other than the portion in the interior of the waveguide 1 (in the illustrated embodiment, the upper and lower sections outside the waveguide). Needless to say, the metal wire or the metal rod may be spirally wound between the cooling water pipe and the insulating tube. A reference numeral 8 designates an inlet for the cooling water for the cooling water pipe 5, and a numeral 9 refers to an outlet for the cooling water.

On and around the portion of the insulating tube 3 which is within the waveguide 1, there is a spirally wound metal wire 4 or metal rod 4 for the air-cooling. Such metal wire 4 or metal rod 4 may either be wound sequentially and closely without gap being left between the adjacent wires or rods, or be spirally wound with a slight space gap being left between them. Further preferred embodiment is that the metal wire 4 or the metal rod 4 which has been spirally wound on and around the insulating tube is additionally soldered for its solid fixing. The illustrated embodiment shows a state in which metal wires 4 are wound with a slight space gap being left between them.

For metal wire 4 or metal rod 4 to be used for the purpose of this invention, there is no particular limitation to the material provided it has good electric conductivity, heat conductivity, and flexibility, in combination. Also, thickness (i.e., diameter) of metal wire 4 may be within a range which is capable of providing its flexibility to such an extent that it can be spirally wound on and around the insulating tube. As an example, copper wire, or other metal wires of 2 to 4 mm in diameter may be used. The portion of the insulating tube 3, on which such metal wire 4 has been wound, is air-cooled by blowing the air from the lateral direction (in the illustrated embodiment, the direction perpendicular to the surface of the drawing with respect to the insulating tube 3 and the micro-wave transmitting axis of the waveguide.

On the side of the rectangular waveguide 1 opposite to its micro-wave introducing side, with the insulating tube 3 being held between them, there is provided a short plunger 2 which functions to cause the insulating tube to slide within the rectangular waveguide 1 from the outside by means of a rod 10. This short plunger 2 can be disposed at its optimum position in the insulating tube where the micro-wave plasma is generated at its highest efficiency, at the time of generating the micro-wave plasma by introduction of the processing gas from the gas inlet port 6 of the insulating tube 3, and taking the supply of the micro-wave electric power from the waveguide 1.

As has been explained in the foregoing, since the micro-wave plasma generating device according to the present invention is of such construction, the whole structure can be made simple in comparison with the conventional ones, in which the water-cooling pipe is wound on and around the insulating tube or a water layer is provided thereon, hence it is possible to readily cool the insulating tube by air-blowing. Actually, in the event that the quartz insulating tube was cooled, as it was, with air, the insulating tube was found liable to be broken due to heat generation, when the micro-wave power of 2.45 GHz was applied at a rate of 1 KW or more. However, in the case of the insulating tube with the metal wire 4 of the present invention being spirally wound therearound, and cooled by air blowing, no breakage could be observed to occur, even if the micro-wave power of 2 KW was used.

Although the invention has been described with reference to a particular embodiment thereof, it should be understood by those persons skilled in the art that the invention is capable of a variety of alternative embodiments without departing from the spirit and scope of the invention as recited in the appended claims.

What is claimed is:

1. Micro-wave plasma generating device which generates the plasma by introduction of a processing gas into an insulating tube transversing through a micro-wave waveguide, and said micro-wave plasma generating device being characterized in that a metal wire or a metal rod is spirally wound on and around said insulating tube for at least the purpose of cooling said insulating tube.

2. Micro-wave plasma generating device according to claim 1, further provided with air-blowing means for cooling said insulating tube, on and around which the metal wire or metal rod is wound, by blowing air thereagainst.

3. Micro-wave plasma generating device according to claim 1, wherein a coil of water-cooling pipe made of metal is wound on and around a portion of said insulating tube, on which the metal wire or metal rod is wound, other than the portion in the interior of said waveguide.

4. Micro-wave plasma generating device according to claim 1, wherein said metal wire or metal rod is soldered.

5. Micro-wave plasma generating device according to claim 1, wherein a portion of said insulating tube not subject to micro-wave irradiation is metallized.

* * * * *